US012059772B2

(12) United States Patent
Giles

(10) Patent No.: US 12,059,772 B2
(45) Date of Patent: Aug. 13, 2024

(54) INTERCHANGABLE FLUID JET TOOL, SYSTEM, AND METHOD FOR USING

(71) Applicant: FMG Innovations, LLC, Saline, MI (US)

(72) Inventor: David Giles, Clinton, MI (US)

(73) Assignee: FMG Innovations, LLC, Saline, MI (US)

( * ) Notice: Subject to any disclaimer, the term of this patent is extended or adjusted under 35 U.S.C. 154(b) by 220 days.

(21) Appl. No.: 17/400,519

(22) Filed: Aug. 12, 2021

(65) Prior Publication Data

US 2023/0049097 A1 Feb. 16, 2023

(51) Int. Cl.

| | |
|---|---|
| ***B24C 1/04*** | (2006.01) |
| ***B24C 5/04*** | (2006.01) |
| ***B24C 7/00*** | (2006.01) |

(52) U.S. Cl.

CPC ..... *B24C 1/045* (2013.01); *B24C 5/04* (2013.01); *B24C 7/0007* (2013.01)

(58) Field of Classification Search

CPC ..... B05B 1/169; B05B 1/1645; B24C 5/04; B24C 1/086; B24C 1/083; B24C 5/02; B24C 7/0007; B24C 1/045; Y10T 83/364

USPC ..... 451/102, 38

See application file for complete search history.

(56) References Cited

U.S. PATENT DOCUMENTS

| | | | | |
|---|---|---|---|---|
| 5,524,821 | A | 6/1996 | Yie | |
| 5,765,756 | A | 6/1998 | Jordan | |
| 2002/0050197 | A1 | 5/2002 | Moutafis | |
| 2009/0165617 | A1 | 7/2009 | Paul | |
| 2015/0209936 | A1* | 7/2015 | Ihara | B05B 1/10 239/589 |
| 2016/0361795 | A1 | 12/2016 | Funatsu | |

OTHER PUBLICATIONS

International Search Report and Written Opinion issued in App. No. PCT/US22/40111, dated Dec. 29, 2022, 14 pages.

* cited by examiner

*Primary Examiner* — Abbie E Quann

(74) *Attorney, Agent, or Firm* — Donald J. Lecher; BUTZEL LONG

(57) ABSTRACT

The disclosure identifies an apparatus, system of and method for using an interchangeable fluid jet tool, the tool in at least one embodiment being a waterjet tool device that may be interchangeably integrated with a machine having any form of reciprocating or rotating pump (which may be used as a coolant or cutting fluid pump), and coupled with a motor powered rotatory drive machine, such as a spindle, having any type of tool interchange attachment and tool holders.

19 Claims, 7 Drawing Sheets

Section A-A

INTERCHANGABLE FLUID JET TOOL, SYSTEM, AND METHOD FOR USING

FIELD OF THE INVENTION

The present disclosure relates generally to a tool used in machining, assembly, and other manufacturing operations. More particularly, the disclosure relates to an interchangeable fluid jet tool apparatus, a system configured to direct a pressurized working fluid in a predetermined direction that may aid in cutting, clearing, cleaning or some other machining, assembly, manufacturing, mining, construction, or demolition operation and a method of using the same.

BACKGROUND

Pressurized fluid cutting and washing devices may be referred to as waterjets when used for cutting materials, and as power washers when running at pressures relatively lower than those used for cutting. A waterjet tool is an industrial tool capable of cutting a wide variety of materials using a pressurized jet of fluid, or a mixture of pressurized fluid and an abrasive substance. Such fluid at an increased pressure over its input pressure is sufficient for cleaning or cutting a workpiece material. Preexisting products consist of a jet tool permanently affixed to a power source that drives the pump and are dedicated applications, such as a waterjet or power washer.

DETAILED DESCRIPTION

Figure 1A:
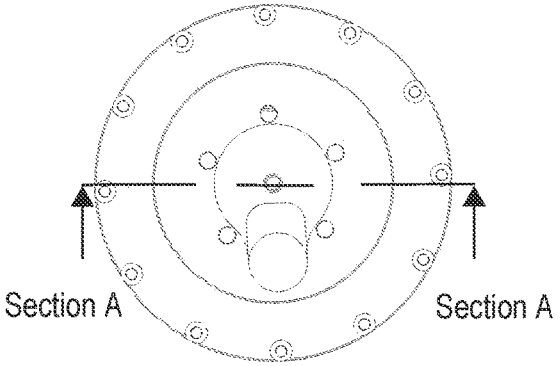
FIG. 1*a* is a top view of an embodiment of a fluid jet tool further displaying Section A-A orientation.
Figure 1B:
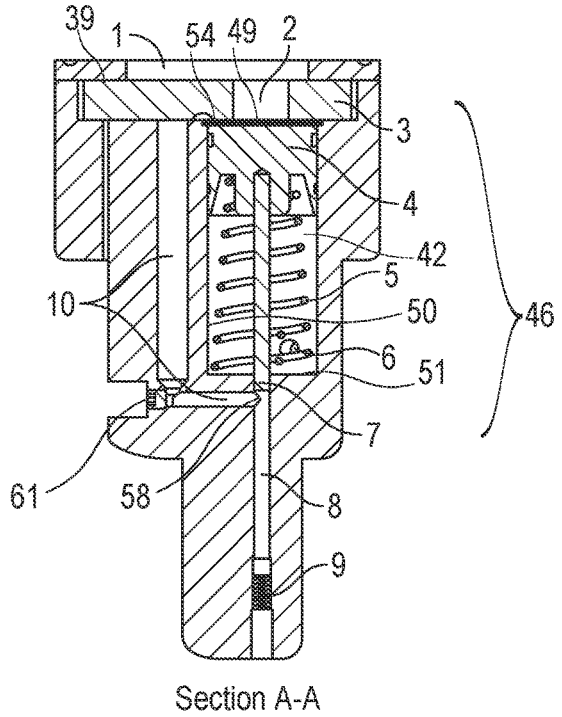
FIG. 1*b* is a section view of an embodiment of a fluid jet tool, having a return spring and at least one main piston, displaying Section A-A.
Figure 2A:
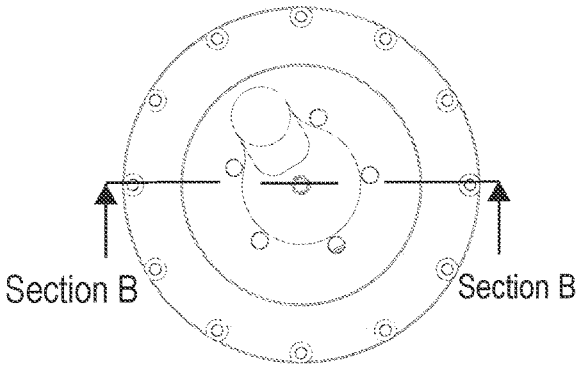
FIG. 2*a* is a top view of an embodiment of a fluid jet tool further displaying Section B-B orientation.
Figure 2B:
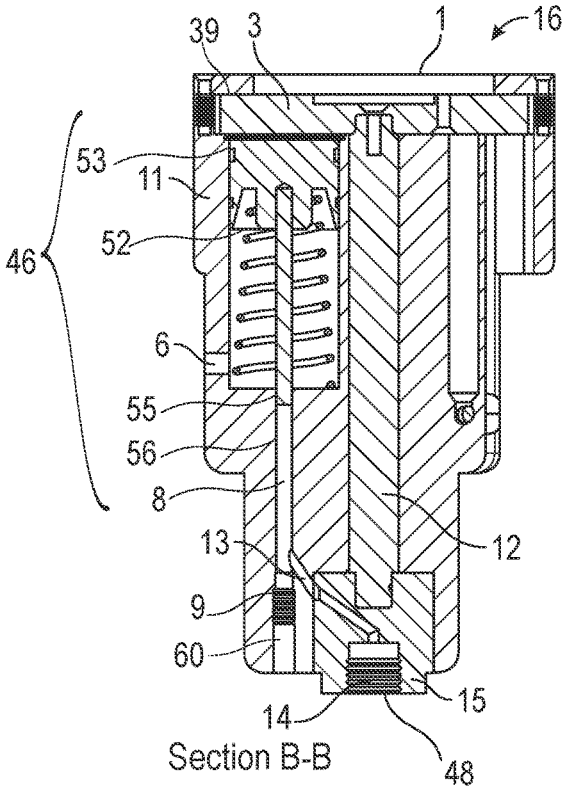
FIG. 2*b* is a section view of an embodiment of a fluid jet tool having a return spring, rotating nozzle adapter output, and at least one main piston, displaying Section B-B.
Figure 3:
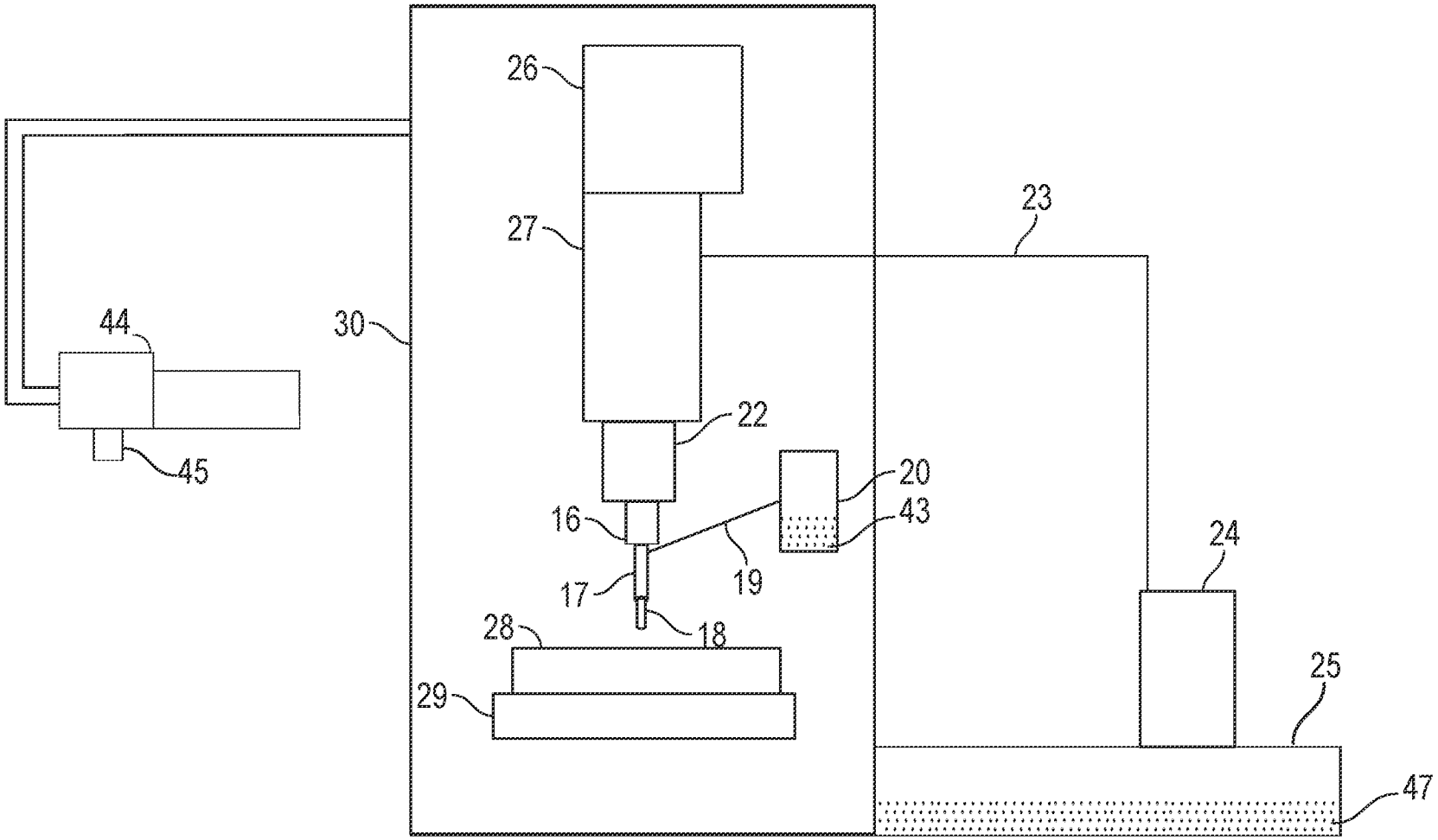
FIG. 3 is a layout of an embodiment of a fluid jet tool system having a fluid jet tool and abrasive configured to be used in connection with the tool of the system.
Figure 4:
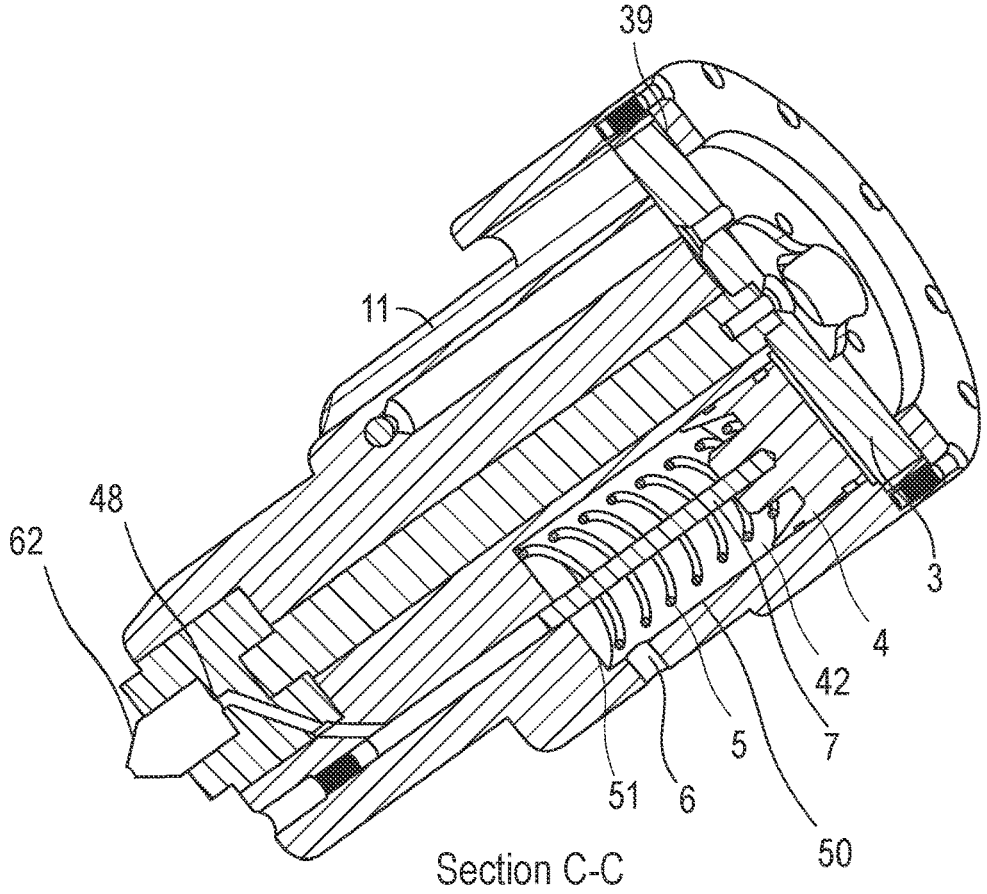
FIG. 4 is a perspective section view of an embodiment of a fluid jet tool, having a return spring, rotating nozzle adapter output, and at least one main piston, displaying Section C-C.
Figure 5:
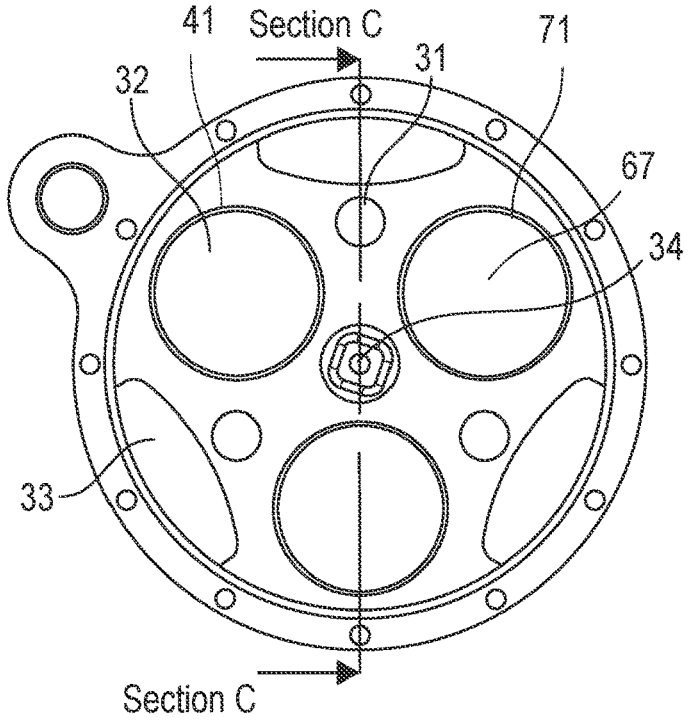
FIG. 5 is a top-view of an embodiment of a fluid jet tool, having three main pistons, wherein the three main pistons are exposed with three pressure piston chamber fill ports and three piston vent relief areas are exposed, displaying Section C-C orientation.
Figure 6A:
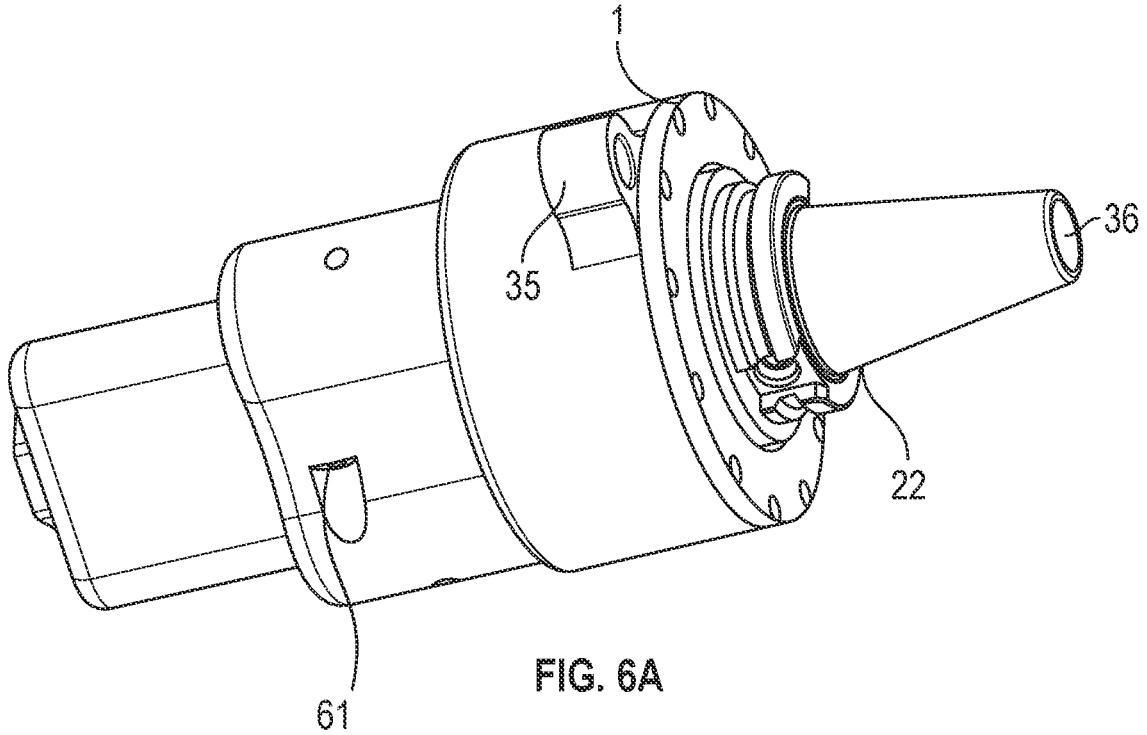
FIG. 6*a* is a side perspective view of an embodiment of a fluid jet tool, having a CAT holder style drive attachment and anti-rotation element.
Figure 6B:
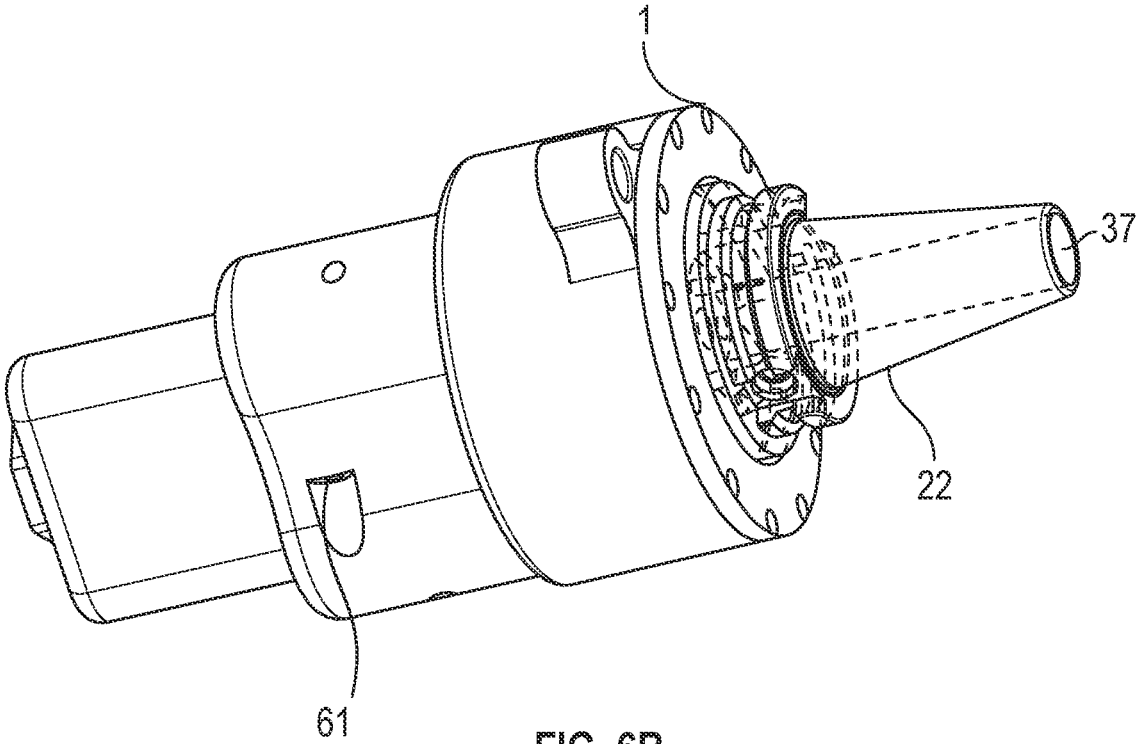
FIG. 6*b* is a side perspective view of an embodiment of a fluid jet tool, having a CAT holder style drive attachment, wherein a fluid passage to a rotating tool attachment disk is shown.
Figure 7:
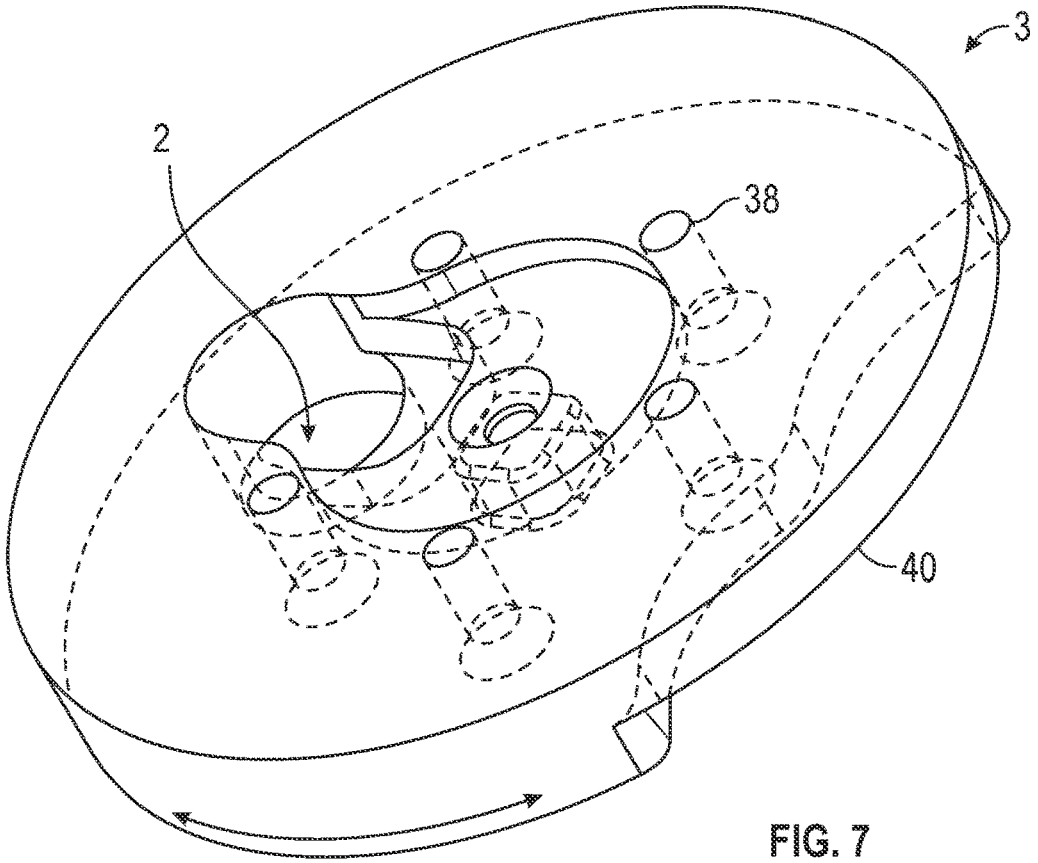
FIG. 7 is a side perspective view of a rotating tool attachment disk plate from an embodiment of a fluid jet tool.
Figure 8:
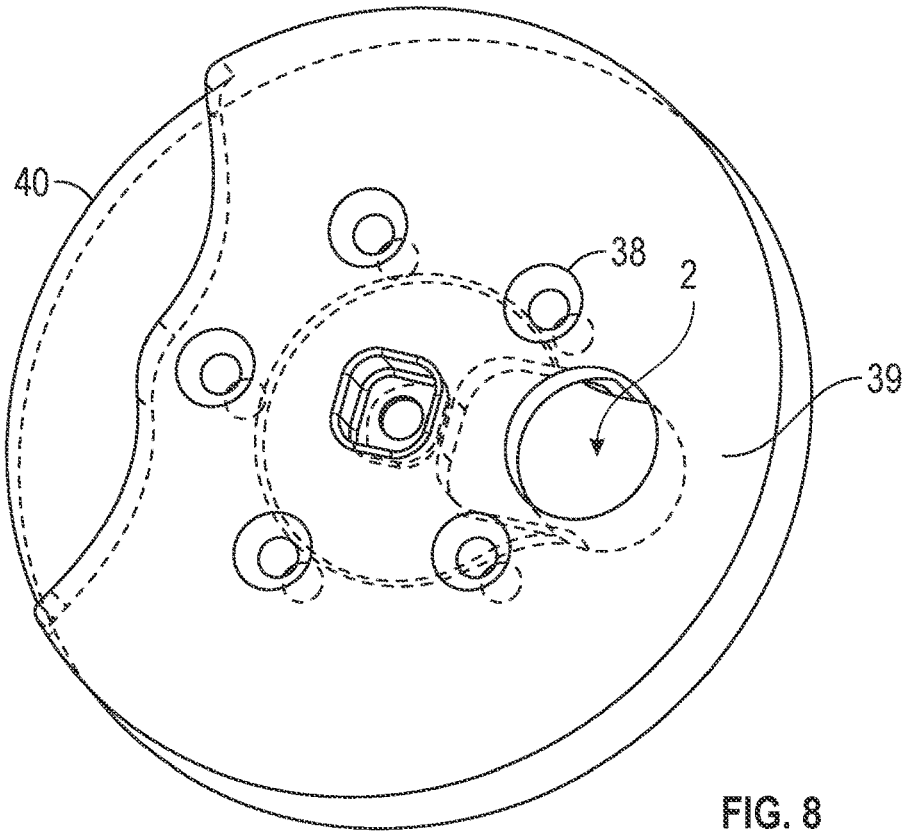
FIG. 8 is a bottom perspective view of a rotating tool attachment disk plate from an embodiment of a fluid jet tool.
Figure 9A:
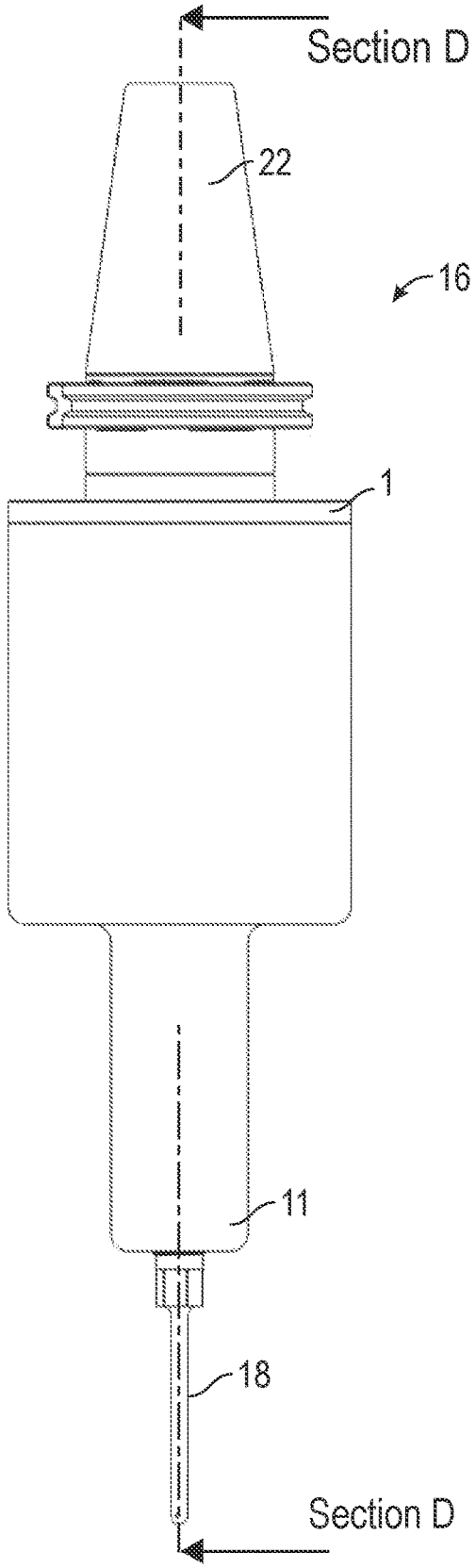
FIG. 9*a* is a side view of an embodiment of a fluid jet tool further displaying Section D-D orientation.
Figure 9B:
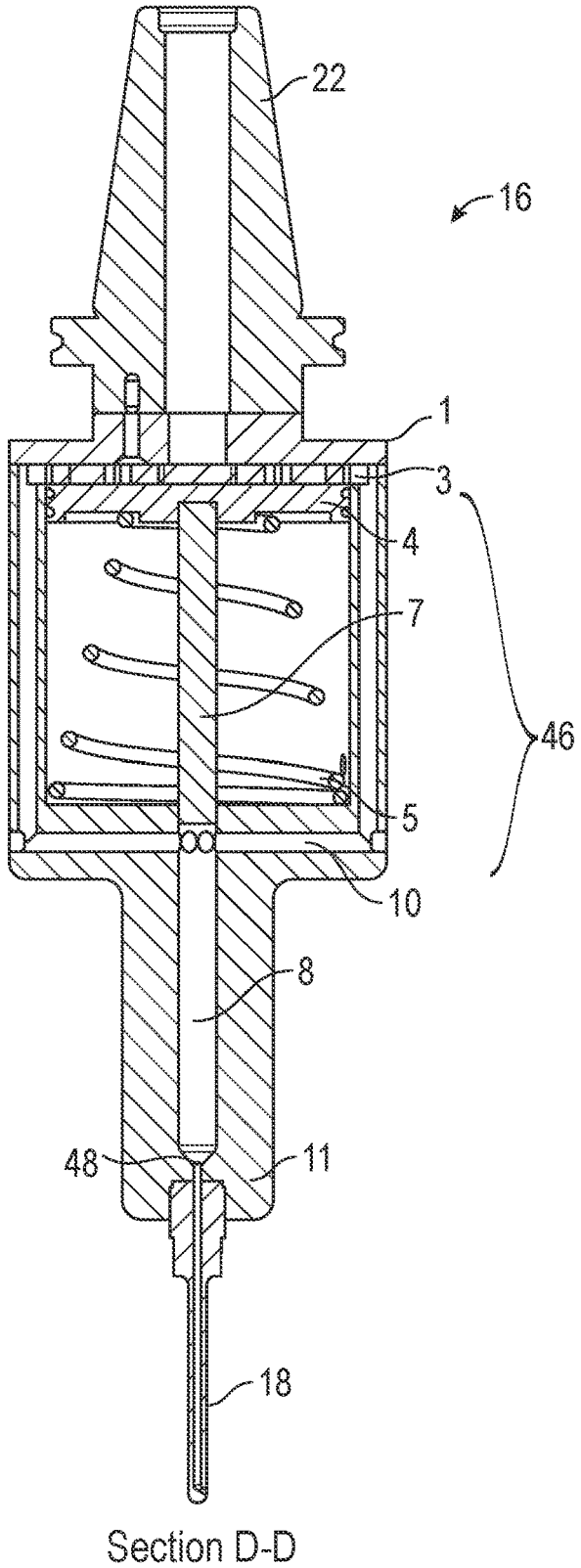
FIG. 9*b* is a side section view of an embodiment of a fluid jet tool, having a return spring and at least one main piston, displaying Section D-D.
Figure 10:
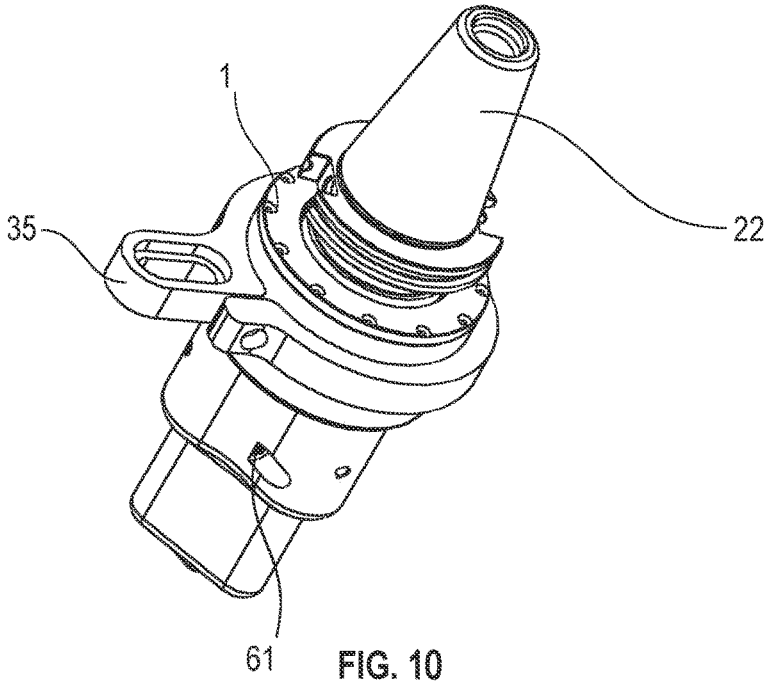
FIG. 10 is a perspective view of embodiment of a fluid jet tool, showing a toolholder body, an attachable nozzle, and an anti-rotation element.
Figure 11A:
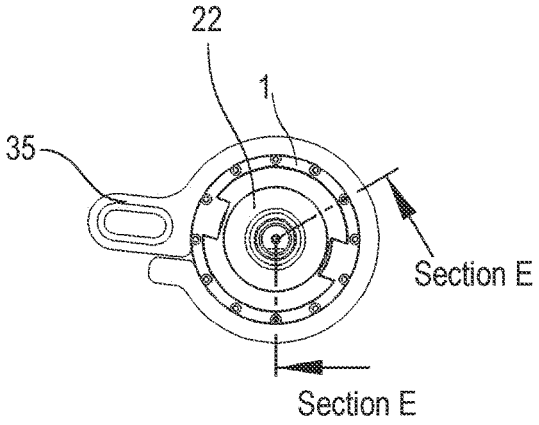
FIG. 11*a* is a top view of an embodiment of a fluid jet tool further displaying Section E-E orientation.
Figure 11B:
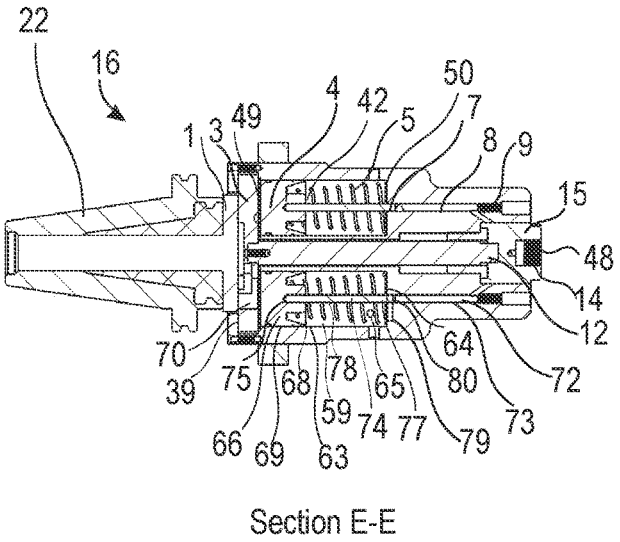
FIG. 11*b* is a section view of an embodiment of a fluid jet tool, having two pump mechanisms in the form of two main pistons, displaying Section E-E.

The disclosure is a novel consolidation of machining and waterjet features, elements of a novel system comprising said machining and waterjet features, and a novel process of using the same.

Reference will now be made in detail to various exemplary embodiments of the disclosure, an example of which is illustrated in the accompanying drawings. In practice, the interchangeable fluid jet tool includes seals, gaskets, and wipers where and as required, which are not shown in the drawings. The following detailed description describes certain embodiments of the disclosure, and should not be considered as limiting the disclosure to those embodiments.

The disclosure identifies an apparatus, system of and method for using an interchangeable fluid jet tool 16. This invention greatly increases the versatility of machining centers by adding a new type of tool that expands a machine's capabilities. No such interchangeable fluid jet tool 16 exists.

The interchangeable fluid jet tool 16, in at least one embodiment, is a waterjet tool device that may be interchangeably integrated with a machine having any form of reciprocating or rotating pump 24 (which may be used as a coolant or cutting fluid pump), and coupled with a motor 26 powered rotatory drive machine 27, such as a spindle, having any type of tool interchange spindle attachment 22 (which may be integral with the spindle) and tool holders (some industry examples being CAT Taper, HSK, BT, R8, Jacobs, or other type, including specific configurations to attach to heavy mobile construction or demolition equipment for the purposes of mining, cutting stone blocks, slabs, and other shapes, or boring tunnels or passages, in stone or other hard compacted material). The machine with a tool interchange spindle attachment 22 may be of the type typically used as a cutting machine with interchangeable tools (commonly known as milling, drilling, or routing machines). The jet tool 16 and machine are parts of a system and are configured to increase pressure of an input fluid and to deliver such pressurized fluid through a nozzle 18 or other mechanism with a nozzle attachment point 14 for industry standard nozzles or for custom nozzles at an output port 15 of the fluid jet tool 16 that can be used to cut, deburr, chamfer or back chamfer, or clean a workpiece 28 mounted in the system on a workpiece holder 29, which may be integral to the machine as part of the machine structure 30 or separate from the machine but still part of the system. The jet tool 16 utilizes the machine's integral power sources when engaged through the jet tool's 16 tool interchange spindle attachment 22, to drive a rotating tool attachment disk 3, which may be configured to rotate about an axis of rotation 34, having drive attachment points 38 and enclosed by a disk capture plate 1. Such tool attachment disk may further be attached to a rotating output port synchronization shaft 12. The fluid jet tool 16 may create a pressure differential configured to generate and deliver the fluid having an increased pressure to cut, deburr, chamfer, back chamfer, or clean material mounted in the machine. The machine structure may also be configured to contain an axis position mechanism which enables movement of the spindle to which the tool may be attached, the workpiece holder, or both.

One embodiment of the apparatus of the disclosure may be automatically interchangeable with other types of tools in the machining system thus enhancing the versatility of the system by enabling it to allow for jet powered cleaning, machining, cutting, deburring, chamfering or back chamfering. Another embodiment of the apparatus of the disclosure may be manually interchangeable.

The fluid of the system need not be water, coolant, or oil, and may be another liquid or gas. The system utilizes the apparatus, as a step within the disclosed method, to raise an input fluid to a pressure suitable for cutting a wide range of materials that could make up the workpiece. The fluid, before being pressurized, may be from the machine's coolant tank, oil tank, or another internal or external source, and the fluid may be filtered or unfiltered. Following the steps of the method of the disclosure, in conjunction with the apparatus of the disclosure, the machine may be configured to generate a reciprocating or rotating motion through any one of the machines integral power sources resulting in, as examples, pressurized air, increased pressure coolant, water, oil, or other liquid or gas. The internal power sources may be the spindle/spindle motor or type of motor, the machine hydraulic system, or other source of creating increased pressure as compared to the input fluid pressure. Some examples of such a source include swash plate driven pistons, cam driven pistons, gear pumps, lobe pumps, sequential rotary or linear intensifier, any type of positive displacement pump or centrifugal pump.

Pumps 24 may be configured to displace a fluid from a fluid reservoir 25 through a fluid feed tube 23 in fluid communication with a rotating disk supply port 2 inside a rotating tool attachment disk 3 of the fluid jet tool 16. Such a rotating disk supply port 2 may be in further fluid communication with the main piston chamber 42 though a main piston chamber fill port 41, on a first surface 32 of a main piston 4 The fluid may be further directed through a pressure piston chamber fill port 31, through a pressure piston chamber fill passage 10 to a pressure piston chamber 8. In one embodiment, the fluid jet tool 16 may include a piston return spring 5. Notably, fluid leakage into the area between a second side of the main piston, where a return spring may be located, and the inner surface bottom wall of the main piston chamber may be vented through exhaust ports 6. This area of the main piston chamber 42 may be configured to contain no more than a minimal amount of fluid of the system such that may result from leakage into that area of the piston chamber. When the fluid of the system is in this area of the piston chamber, the exhaust port 6 may be configured to release such fluid.

In another embodiment of the disclosure, a portion of the pressurized fluid from one piston actuation may be gated to act upon the lower surface of another main piston, already acted upon, to return it to its starting or unpressurized position.

The apparatus may have a nozzle 18, 62 configured to direct the increased-pressure fluid stream, and it may be further configured to manage the pressure and further controls or directs the pressurized fluid stream in the direction of a workpiece. Such nozzle may be integrated into the tool or the nozzle 18 may be removable.

The nozzle 18, 62 may be a rotating nozzle attachment at the output port 15 or a non-rotating nozzle attachment. The pressure output from each pressure piston chamber 8 may be further directed to a common output passage (such as a junction or union of passages). With the nonrotating nozzle attachment, the passage leading to the junction may have a check valve configured to allow flow only in the direction of the common output. This valve may be configured to prevent a pressurized fluid of the system from one piston chamber from going into another piston chamber not configured to be simultaneously pressurized as the tool attachment disk rotates during a method step of the disclosure. With the rotating nozzle attachment, the nozzle ports may align with the pressurized piston output, allowing pressurized fluid to travel to the nozzle while otherwise blocking the output from non-pressurized chambers and preventing the pressurized fluid from traveling into those chambers rather than out of the nozzle.

When used in the system of the disclosure, the apparatus may be configured to operate at the speed the distribution plate is being rotated by a spindle. Alternatively, the system may have gears between the drive axis of a spindle or other rotary machine and the tool attachment plate such that the attachment plate may be configured to rotate at a different speed of rotation than the drive machine.

Check valves are not necessary for operation of one embodiment of the apparatus, whether the system where such apparatus may be included comprises gears or no gears, such as where the apparatus comprises a rotating nozzle, as a rotating nozzle sequentially aligns with the chamber being pressurized as the distribution plate rotates.

Such configuration allows for a rotating stream of pressurized fluid to be set at an angle from the axis which may aid in operation of the system of the disclosure for purposes of chamfering, deburring (removing jagged edges), or performing cutting or cleaning at an angle in relation to the main axis of the apparatus body and drive. Rotating nozzle configurations allow for nozzles with the pressurized fluid coming out of the nozzle at an angle to the main axis of rotation; allowing for chamfering or back chamfering of edges or holes in the workpiece, or making conical cuts in the workpiece.

The system may be configured to provide a continuous stream of increased-pressure fluid, a single shot of increased-pressure fluid having a fixed amount of fluid, or an intermittent pulse of increased-pressure fluid.

In addition, the system may contain means for feeding an abrasive or solid material 43 (such as sand, fiber, metallic, carbon-based materials, stone materials such as garnet or engineered materials, or otherwise), through an abrasive feed tube 19 into the pressurized fluid, and the fluid jet tool 16 may be configured to allow fluid flow with an abrasive or solid material 43, or further configured to control or direct said material. The system may have a refillable cavity or reservoir 20 to hold and introduce such materials 43 into the fluid stream.

In one embodiment of the apparatus of the disclosure, the apparatus may be configured to be a tool-holder-mounted, machine driven interchangeable fluid jet cutting tool 16. Any such device of the system may be capable of being automatically loaded via standard tool machine tool changers or manually loaded by a human or robot.

The apparatus of the disclosure may be configured to be a non-permanent application of an interchangeable fluid jet tool 16 whereby the apparatus may be removably connected to and driven by a spindle on a common manual or CNC machine (a computer numerical control machine) such as a mill, drill, router, lathe, or other style, and may be further configured as an apparatus and as part of a system to be implemented by either manually or automatically changing tools attached to the spindle and spindle drive mechanism.

When used in a system with an operator or a robot tool changer 44 by predetermined or triggered actuation in conjunction with a processor 45, the apparatus may be configured such that changing tools from a machine, like a spindle and spindle drive system, may be possible allowing the spindle or other machine to be free to readily drive other types of tools. The disclosed method allows for rapid interconnection and disconnection of an apparatus of the disclosure to a system. All three are new and novel.

The pump mechanism 46 of the apparatus may be configured such that when used with a system, the pump mechanism generates a pressure and displaces a working fluid of the system. The pump mechanism may further be any known, unknown, existing, or disclosed pump style configured in such a way as to be driven by a machining center's spindle through adaption of its drive connection tool attachment element to a tool holder mechanism of the spindle or drive center, whether it be HSK, CAT, R8, BT CAPTO, or other.

In one embodiment, the flow of the working fluid may be moderated by rotation of a rotary drive device of the machine and the machine's integral fluid source, while in another embodiment the working fluid may be supplied from a source outside of the rotary drive machine. The rotating output port synchronization shaft 12 may act as a pump of the low-pressure fluid supplied to the disk supply 2 to the pump mechanism 46. In one embodiment, as the rotating output port synchronization shaft 12 spins, fluid may be passed through the rotating tool attachment disk 3, through the disk capture plate 1, and into the pump mechanism 46 where it may be charged and expelled after being pressurized by the pressure piston 7 in an intermittent fashion, or a constant pressurized stream may be discharged when multiple pressure pistons 7 or other pump mechanisms 46 are employed. When external fluid sources are used, an external pump may be employed in a system, may be connected to a port on the interchangeable fluid jet tool 16, wherein the port may be in fluid communication with the first main piston chamber 42 and the external fluid source. The disclosed apparatus may be configured to receive the working fluid, regardless of the source, and through the disk supply port 2 to the pump mechanism 46.

Relative to the output pressure of the system of the disclosure, the input fluid pressure may be lower. In each embodiment, the output pressure has a pressure greater than the input pressure based on a predetermined ratio. In one embodiment, the ratio of input pressure to output pressure may be 2:1. In one embodiment, the input pressure may be in the range between 500 and 1,000 PSI. In one embodiment, the output pressure may be between 20,000 and 90,000 PSI. In yet another embodiment, the input pressure may be between 10 and 500 PSI. In yet another embodiment, the output pressure may be between 20 and 20,000 PSI. In yet another embodiment, the input pressure may be greater than 1,000 PSI. In yet another embodiment, the output pressure may be greater than 90,000 PSI.

One embodiment of the fluid jet tool 16 comprises a tool interchange spindle attachment 22 having a disk supply port 2 fluid supply passage 37; a pump mechanism 46, wherein the pump mechanism 46 has a pump mechanism fluid passage defined by a passage input 49 to a passage output 48; a rotating tool attachment disk 3, wherein the rotating tool attachment disk 3 rotates about an axis of rotation 34, configured to be removably connected to a rotary drive machine 27 via drive attachment points 38, and further having a rotating disk supply port 2, said attachment disk fill port configured to be in fluid communication with the pump mechanism fluid passage input 49; a housing 11 with an anti-rotation element 35; a disk capture plate 1, said disk capture plate 1 removably connected to the housing 11, the disk capture plate 1 further comprising a disk capture plate inner surface 39 wherein the disk capture plate inner surface 39 has a sliding relationship with the rotating tool attachment disk 3; and, an attachment nozzle 18, said attachment nozzle 18 configured to be in fluid communication with the pump mechanism 46 at the pump mechanism fluid passage output 48.

As used herein, the term "fixedly" includes permanent connections, such as casted or welded, or otherwise inextricably linked connections, as well as connections that may be removed by mechanical operations such as removal by screw, bolt, clip or other latching or similar connection means.

The pump mechanism 46 fluid passage input 49 to fluid passage output 48 may be configured to pass fluid from the pump mechanism 46 fluid passage input 49, which in one embodiment may be configured to be in fluid communication with a fluid reservoir 25 and fluid connection means 23 such as tubing, piping, or other similar fluid transport devices, and pump mechanism 46 fluid passage input 49 may be configured in this embodiment to be the input to the pump mechanism 46, which may be upstream and in fluid communication with the pump mechanism fluid passage output 48.

The pump mechanism 46 of the fluid jet tool 16 may further comprise a first main piston chamber 42 having an inner surface side wall 50, and inner surface bottom wall 51. Also included in fluid communication with the first main piston chamber 42 may be an exhaust port 6, a relieved fluid escape passage 33 and a piston vent relief area 40, which are configured to function in conjunction with one another. This is possible because, in one embodiment, the piston vent relief area 40 may be configured on the rotating tool attachment disk 3. Also within the first main piston chamber 42 may be a first main piston 4 having a first piston surface 32 configured near the rotating tool attachment disk 3, a second piston surface 52 configured opposite of the first piston surface 32 about the first main piston 4 and distally from the rotating tool attachment disk 3, and a circumferential piston surface 53. The circumferential surface 53 of the first main piston 4 may have a sliding contact relationship with the inner surface side wall 50 of the first main piston chamber 42. Also in fluid communication with the first main piston chamber 42 may be a main piston chamber fill passage 54, both in fluid communication with the rotating tool attachment disk supply port 2. The first main piston chamber 42 may also be configured to have a first main piston chamber fill port 41, wherein the first main piston chamber fill port 41 may be in fluid communication with the first main piston chamber fill passage 54. Located distally from the first main piston 4 may be a first pressure piston chamber 8 having an inner surface. The first main piston 4 and first pressure piston 7 may be integrated as a single component.

In one embodiment, a first pressure piston 7 having a first end fixedly connected to the second surface 52 of the first main piston 4 and a second end configured opposite of the first end about the first pressure piston 7 and distally from the first main piston 4, and a pressure piston circumferential surface 55, may be configured such that the pressure piston circumferential surface 55 has a sliding contact relationship with an inner surface 56 of a first pressure piston chamber 8. For fluid to enter the first pressure piston chamber 8, a first pressure piston chamber fill passage 54 and a first pressure piston chamber fill port 58 are configured to be in fluid communication with the first main piston chamber fill passage 54 and the first main piston chamber fill port 58. The interchangeable fluid jet tool 16 may further have an output port 15 having at least one passage, where the at least one passage of the output port 15 may be configured to be in fluid communication with the first pressure piston chamber 8 and the attachment nozzle 18, 62.

In one embodiment of the disclosure, the fluid jet tool 16 may further comprise a piston return spring 5 that acts between the piston housing 11 and a feature of the main piston 4 which may be configured to act with a predetermined spring force on the main piston 4 of the embodiment of the disclosure. The spring 5 returning the main piston 4 to its start position after the release of low-pressure fluid to the face of the piston 32 opposite the springs force. The designer or user of the fluid jet tool 16 may select a certain spring 5 having a predetermined spring constant in order to calibrate the fluid jet tool 16 or to otherwise adapt the fluid jet tool 16 to fit its intended use.

In one embodiment of the disclosure, the fluid jet tool 16 may further comprise a second main piston chamber 59 configured in the same way as the first main piston chamber 42, having: an inner surface side wall 63, and inner surface bottom wall 64, and an exhaust port 65; a second main piston 66 having a first surface 67 configured near the rotating tool attachment disk 3, a second surface 68 configured opposite of the first surface 67 about the second main piston 66 and distally from the rotating tool attachment disk 3, and a circumferential surface 69, wherein the circumferential surface 69 of the second main piston 66 has a sliding contact relationship with the inner surface side wall 63 of the second main piston chamber 59; a main piston chamber fill passage 70; a second main piston chamber fill port 71, wherein the second main piston chamber fill port 71 may be in fluid communication with the second main piston chamber fill passage 70; a second pressure piston chamber 72 having an inner surface 73; a second pressure piston 74 having a first end 75 that may be fixedly connected to the second surface of the second main piston 66, a second end 77 configured opposite of the first end 75 about the second pressure piston 74 and distally from the second main piston 66, and a circumferential surface 78, wherein the circumferential surface 78 has a sliding contact relationship with the inner surface 73 of the second pressure piston chamber 72; a second pressure piston chamber fill passage 79; and a second pressure piston chamber fill port 80, wherein the second pressure piston chamber fill port 80 may be in fluid communication with the second main piston chamber fill passage 79 and the second main piston chamber fill port 80; and wherein the output port 15 having at least one passage may be further configured to be in fluid communication with the second pressure piston chamber 72.

In one embodiment of the apparatus of the disclosure, the rotating tool attachment disk 3 of the fluid jet tool 16 may further comprise a second disk fluid supply passage.

Additionally, the rotating tool attachment disk 3 may further comprise a first main piston chamber fill port, a first pressure piston chamber fill port, and a first piston vent relief area.

The rotating tool attachment disk 3 may also have a second main piston chamber fill port, a second pressure piston chamber fill port, and a second piston vent relief area.

One embodiment of the apparatus of the disclosure may further include a first pressure piston chamber vent relief passage 60, a similar second pressure piston chamber vent relief passage, a first pressure piston chamber vent relief check valve 9, and a first pressure piston fill passage cross-hole plug 61.

One embodiment of the apparatus of the disclosure may further include a second main piston chamber vent relief check valve.

The first main piston chamber of one embodiment of the disclosure and the first pressure piston chamber of such an embodiment are contemplated to be related via a predetermined aspect ratio.

In one embodiment of the apparatus of the disclosure, the pump mechanism 46 may be contemplated to be a swash plate driven piston pump. In one embodiment, the pump mechanism 46 may be contemplated to be a cam driven piston pump. In one embodiment, the pump mechanism 46 may be contemplated to be a gear pump. In one embodiment, the pump mechanism 46 may be contemplated to be a lobe pump. In one embodiment, the pump mechanism 46 may be a positive displacement pump. In one embodiment, the pump mechanism 46 may be contemplated to be a centrifugal pump.

The use of the fluid jet tool 16 of the disclosure may further be used as part of a fluid jet system where one embodiment of a fluid jet tool system may comprise a fluid jet tool 16 having a tool drive attachment 22 with a tool attachment disk fluid entry 36, a tool attachment disk first disk fluid supply passage 37, a fluid inlet 2, and a pump mechanism 46; an abrasive 43; abrasive feed tubing 19; a mixing tube 17; a motor 26; a rotating drive machine 27; a working fluid pump 24; a working fluid reservoir 25; a working fluid 47; working fluid routing means 23; a workpiece holder 29; and a workpiece 28.

Such a system may further comprise means for positioning a tool such as a processor or manual positioning mechanism such as axis handles, an axis positioning device that may be adjustable, such as axis jog buttons or hand wheel with selectable axis and feed rate settings, or a CNC machine having jog, feed, or rapid modes; and an adjustable cut pattern, where the cut pattern can be adjusted manually or by a cut pattern computer program (in G, M, and S code or other machine programming code) capable of being loaded or programed into the system's processor for semi-automatic or automatic operation.

In one embodiment, the workpiece in the workpiece holder and the spindle with the attached fluid jet tool 16 may be configured to move on a set of axes according to the program in the processor or by manual positioning to predetermined positions to achieve the cut pattern. Such positioning may be enabled by axis jog buttons or hand wheel with selectable axis and feed rate settings, or a CNC machine having jog, feed, or rapid modes.

In one embodiment of a fluid jet system, the system may be configured to include abrasives and an abrasive storage location, wherein the working fluid further comprises the abrasives, the fluid jet tool 16 may be further configured to connect to the abrasive storage location, either manually or automatically, and to contain and discharge the working fluid having abrasives in a predefined path in the direction of the workpiece, the fluid distribution pump may be further configured to displace the working fluid further comprising abrasives, and the fluid routing components are further configured to contain the working fluid having abrasives.

In one embodiment of a fluid jet system, the robot tool changer 44 includes a processor 45. Such processor 45 may be configured to contain the adjustable cut pattern that may be programed into the processer 45. As used in the machining industry, the processor 45 delivers commands to the system and an axis positioning mechanism which may be part of the machine, wherein the workpiece holder 29 and rotary drive machine 27 may be configured to move in accordance with the cut pattern programed into the processor 45.

The fluid jet tool 16 and system of the disclosure may be utilized, separately or in conjunction, by a method of using a fluid jet system and tool, comprising some or all of the steps of: selecting a rotary drive machine; determining a cut pattern for a workpiece; determining the cut pattern and preserving the cut pattern for future use, such as recording it in a tangible medium that can be followed using a manual positioning mechanism, or programing the cut pattern into a processor; loading the workpiece into a workpiece holder; selecting a fluid jet tool 16 configured to connect to the rotary drive machine based on an operator's predetermined use; removing the fluid jet tool 16 from a non-use storage location; loading the fluid jet tool 16 onto the rotary drive machine; bringing the fluid jet tool 16 into cutting distance of the workpiece; positioning the workpiece holder and rotary drive machine into a predetermined starting position by either executing the processor, or manually moving the machine axis; powering on the rotary drive machine; moving the workpiece holder and rotary drive machine in accordance with the cut pattern, either by executing the processor to move the workpiece or by positioning the workpiece manually using the manual positioning mechanism; displacing a working fluid through the fluid jet tool 16; performing fluid jet tool operations such as cleaning, cutting, chamfering, back chamfering, and/or clearing the workpiece using the fluid jet tool 16 and working fluid according to the manual or programmed pattern; powering off the rotary drive machine; unloading the fluid jet tool 16; and returning the fluid jet tool 16 to the non-use storage location.

The method of the disclosure may be further contemplated such that wherein removing the fluid jet tool 16 from a non-use storage location, loading the fluid jet tool 16 onto the rotary drive machine, unloading the fluid jet tool 16, and returning the fluid jet tool 16 to the non-use storage location further comprises using an automatic tool changer such as a robot.

In one embodiment of the method of the disclosure, the method further comprises loading abrasives into an abrasive storage container and injecting abrasives into the working fluid substantially after pumping the working fluid through the interchangeable fluid jet tool 16, and before the output nozzle, using the fluid distribution pump, and wherein the step for cutting the workpiece using the fluid jet tool 16 and working fluid according to the cut pattern further comprises cutting the workpiece using the fluid jet tool 16 and working fluid injected with abrasives according to the cut pattern. In this instance, substantially before means that at least a portion of the working fluid may be pumped through the fluid jet tool 16 using the fluid distribution pump before the working fluid may be injected with the abrasives.

When the method of the disclosure may be employed in an embodiment with a system and apparatus of the disclosure including a processor, an additional step of programing the cut pattern into the processor after determining the cut pattern for the workpiece may be contemplated by the disclosure. In addition, when a processor may be used, positioning the workpiece holder and rotary drive machine into a predetermined starting position includes executing the processor to maneuver the components of the system about the axis positioning mechanism of the system. Further, moving the workpiece holder and rotary drive machine in accordance with the cut pattern includes executing the processor to maneuver the workpiece holder and rotary drive machine about the axis positioning mechanism.

The disclosure contemplates the reduction in cost of productions and efficiency improvements in machining and manufacturing processes, including system, apparatus, and process design and efficiency.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

As such, those skilled in the art will appreciate that the conception upon which this disclosure is based may readily be utilized as a basis for the designing of other structures, methods and systems for carrying out the several purposes of the present disclosure. It is important, therefore, that the description be regarded as including such equivalent constructions insofar as they do not depart from the spirit and scope of the present disclosure.

What is claimed is:

1. An interchangeable fluid jet tool, comprising:

a tool-attachment element having a first disk fluid supply passage;

a pump mechanism, including a fluid passage having an input and an output opposite that of the input;

a tool attachment disk, wherein the tool attachment disk is configured to rotate about an axis of rotation, the tool attachment disk further configured to be removably connected to a rotary drive machine, and the tool attachment disk further having an attachment disk fill port, said attachment disk fill port configured to be in fluid communication with the input of the fluid passage of the pump mechanism;

a housing;

a disk capture plate, said disk capture plate removably connected to the housing, the disk capture plate further comprising a disk capture plate inner surface wherein the disk capture plate inner surface has a sliding relationship with the tool attachment disk; and an attachment nozzle, said attachment nozzle configured in fluid communication with the output of the fluid passage of the pump mechanism.

2. The interchangeable fluid jet tool of claim 1, wherein the pump mechanism further comprises:

a first main piston chamber having an inner surface side wall, an inner surface bottom wall, and an exhaust port;

a first main piston having a first surface configured near the tool attachment disk, a second surface configured opposite of the first surface about the first main piston and distally from the tool attachment disk, and a first main piston circumferential surface, wherein the first main piston circumferential surface of the first main piston has a sliding contact relationship with the inner surface side wall of the first main piston chamber;

a first main piston chamber fill passage in fluid communication with the attachment disk fill port;

a first main piston chamber fill port, wherein the first main piston chamber fill port is in fluid communication with the first main piston chamber fill passage;

a first pressure piston chamber having an inner surface;

a first pressure piston having a first end that is fixedly connected to the second surface of the first main piston, a second end configured opposite of the first end about the first pressure piston and distally from the first main piston, and a first pressure piston circumferential surface, wherein the first pressure piston circumferential surface has a sliding contact relationship with the inner surface of the first pressure piston chamber;

a first pressure piston chamber fill passage;

a first pressure piston chamber fill port, wherein the first pressure piston chamber fill port is in fluid communication with the first main piston chamber fill passage; and an output port having at least one passage, the at least one passage of the output port configured to be in fluid communication with the first pressure piston chamber and the attachment nozzle.

3. The interchangeable fluid jet tool of claim 2, further comprising a piston return spring.

4. The interchangeable fluid jet tool of claim 2, further comprising:

a second main piston chamber having an inner surface side wall, and an inner surface bottom wall, and an exhaust port;

a second main piston having a first surface configured near the tool attachment disk, a second surface configured opposite of the first surface of the second main piston about the second main piston and distally from the tool attachment disk, and a second main piston circumferential surface, wherein the second main piston circumferential surface of the second main piston has a sliding contact relationship with the inner surface side wall of the second main piston chamber;

a second main piston chamber fill passage;

a second main piston chamber fill port, wherein the second main piston chamber fill port is in fluid communication with the second main piston chamber fill passage;

a second pressure piston chamber having an inner surface;

a second pressure piston having a first end that is fixedly connected to the second surface of the second main piston, a second end configured opposite of the first end of the second pressure piston about the second pressure piston and distally from the second main piston, and a second pressure piston circumferential surface, wherein the second pressure piston circumferential surface has a sliding contact relationship with the inner surface of the second pressure piston chamber;

a second pressure piston chamber fill passage; and a second pressure piston chamber fill port, wherein the second pressure piston chamber fill port is in fluid communication with the second main piston chamber fill passage, wherein the output port having the at least one passage is further configured to be in fluid communication with the second pressure piston chamber.

5. The interchangeable fluid jet tool of claim 2, wherein the tool attachment disk further comprises a second disk fluid supply passage.

6. The interchangeable fluid jet tool of claim 2, wherein the tool attachment disk further comprises:

a first plate main piston chamber fill port;

a first plate pressure piston chamber fill port;

a first relieved fluid escape passage; and a first piston vent relief area.

7. The interchangeable fluid jet tool of claim 2, wherein the tool attachment disk further comprises:

a second plate main piston chamber fill port;

a second plate pressure piston chamber fill port;

a second relieved fluid escape passage; and a second piston vent relief area.

8. The interchangeable fluid jet tool of claim 2, further comprising:

a first main piston chamber vent relief passage;

a first pressure piston vent relief passage; and a first pressure piston chamber vent relief check valve.

9. The interchangeable fluid jet tool of claim 8, further comprising:

a second main piston chamber vent relief passage;

a second pressure piston vent relief passage; and a second pressure piston chamber vent relief check valve.

10. The interchangeable fluid jet tool of claim 1, wherein the pump mechanism is one from a group consisting of:

a swash plate driven piston pump;

a cam driven piston pump;

a gear pump;

a lobe pump;

a positive displacement pump; and a centrifugal pump.

11. An interchangeable fluid jet system, comprising:

a working fluid;

a rotary drive machine having a motor;

a workpiece holder;

a fluid distribution pump, the fluid distribution pump configured to pump the working fluid;

a fluid reservoir, the fluid reservoir configured to contain the working fluid;

an interchangeable fluid jet tool including a tool-attachment element having a first disk fluid supply passage, a pump mechanism, including a fluid passage having an input and an output opposite that of the input, a tool attachment disk, wherein the tool attachment disk is configured to rotate about an axis of rotation, the tool attachment disk further configured to be removably connected to the rotary drive machine, and the tool attachment disk further having an attachment disk fill port, said attachment disk fill port configured to be in fluid communication with the input of the fluid passage of the pump mechanism, a housing, a disk capture plate, said disk capture plate removably connected to the housing, the disk capture plate further comprising a disk capture plate inner surface wherein the disk capture plate inner surface has a sliding relationship with the tool attachment disk, and an attachment nozzle, said attachment nozzle configured in fluid communication with the output of the fluid passage of the pump mechanism; and fluid routing components configured to contain the working fluid, the fluid routing components further configured in fluid communication with the fluid distribution pump, the fluid reservoir, and the interchangeable fluid jet tool, wherein the interchangeable fluid jet tool is configured to be removably connected to the rotary drive machine, the interchangeable fluid jet tool configured to contain and discharge the working fluid in a direction of a workpiece.

12. The interchangeable fluid jet system of claim 11, further comprising:

a tool changer; and a processor, wherein an adjustable cut pattern is programed into the processor, wherein the workpiece holder and the rotary drive machine are configured to move in accordance with the adjustable cut pattern programed into the processor.

13. The interchangeable fluid jet system of claim 11, further comprising:

abrasives and an abrasive storage location, wherein the working fluid further comprises the abrasives from the abrasive storage location, the interchangeable fluid jet tool is further configured to connect to the abrasive storage location, and to discharge the working fluid comprising the abrasives in the direction of the workpiece, the fluid distribution pump is further configured to pump the working fluid comprising the abrasives, and the fluid routing components are further configured to contain the working fluid comprising the abrasives.

14. The interchangeable fluid jet system of claim 11, wherein the pump mechanism further comprises:

a first main piston chamber having an inner surface side wall, an inner surface bottom wall, and an exhaust port;

a first main piston having a first surface configured near the tool attachment disk, a second surface configured opposite of the first surface about the first main piston and distally from the tool attachment disk, and a first main piston circumferential surface, wherein the first main piston circumferential surface of the first main piston has a sliding contact relationship with the inner surface side wall of the first main piston chamber;

a first main piston chamber fill passage in fluid communication with the attachment disk fill port;

a first main piston chamber fill port, wherein the first main piston chamber fill port is in fluid communication with the first main piston chamber fill passage;

a first pressure piston chamber having an inner surface;

a first pressure piston having a first end that is fixedly connected to the second surface of the first main piston, a second end configured opposite of the first end about the first pressure piston and distally from the first main piston, and a first pressure piston circumferential surface, wherein the first pressure piston circumferential surface has a sliding contact relationship with the inner surface of the first pressure piston chamber;

a first pressure piston chamber fill passage;

a first pressure piston chamber fill port, wherein the first pressure piston chamber fill port is in fluid communication with the first main piston chamber fill passage; and an output port having at least one passage, the at least one passage of the output port configured to be in fluid communication with the first pressure piston chamber and the attachment nozzle.

15. The interchangeable fluid jet system of claim 11, further comprising at least two gears positioned between a drive axis of the rotary drive machine having the motor and the interchangeable fluid jet tool configured to rotate an attachment plate of the interchangeable fluid jet tool at a speed of rotation different than the rotary drive machine having the motor.

16. A method of using an interchangeable fluid jet system and an interchangeable fluid jet tool, comprising:

providing the interchangeable fluid jet tool configured to connect to a rotary drive machine, the interchangeable fluid jet tool including:

a tool-attachment element having a first disk fluid supply passage, a pump mechanism, including a fluid passage having an input and an output opposite that of the input, a tool attachment disk, wherein the tool attachment disk is configured to rotate about an axis of rotation, the tool attachment disk further configured to be removably connected to the rotary drive machine, and the tool attachment disk further having an attachment disk fill port, said attachment disk fill port configured to be in fluid communication with the input of the fluid passage of the pump mechanism, a housing, a disk capture plate, said disk capture plate removably connected to the housing, the disk capture plate further comprising a disk capture plate inner surface wherein the disk capture plate inner surface has a sliding relationship with the tool attachment disk, and an attachment nozzle, said attachment nozzle configured in fluid communication with the output of the fluid passage of the pump mechanism;

loading the interchangeable fluid jet tool onto the rotary drive machine;

positioning a workpiece holder and the rotary drive machine into a starting position about an axis positioning mechanism;

pumping a working fluid through the interchangeable fluid jet tool using a fluid distribution pump; and performing fluid jet tool operations on a workpiece using the interchangeable fluid jet tool and the working fluid according to a cut pattern.

17. The method according to claim 16, further comprising using an automatic tool changer to:

remove the interchangeable fluid jet tool from a non-use storage location;

load the interchangeable fluid jet tool onto the rotary drive machine;

unload the interchangeable fluid jet tool; and return the interchangeable fluid jet tool to the non-use storage location.

18. The method according to claim 16, further comprising:

loading abrasives into an abrasive storage container and injecting the abrasives into the working fluid substantially after pumping the working fluid through the interchangeable fluid jet tool using the fluid distribution pump; and cutting the workpiece using the interchangeable fluid jet tool and the working fluid injected with the abrasives according to the cut pattern.

19. The method according to claim 16, further comprising:

programing the cut pattern into a processor after determining the cut pattern for the workpiece, positioning the workpiece holder and the rotary drive machine into a starting position; and executing the processor to maneuver the workpiece holder and the rotary drive machine about the axis positioning mechanism in accordance with the cut pattern.

* * * * *